US008411005B2

(12) United States Patent
Park et al.

(10) Patent No.: US 8,411,005 B2
(45) Date of Patent: Apr. 2, 2013

(54) LIQUID CRYSTAL DISPLAY APPARATUS AND DRIVING METHOD THEREFOR

(75) Inventors: Dong-Joon Park, Chungcheongnam-do (KR); Jung-Mok Han, Chungcheongnam-do (KR); Jeong-Hyun Kim, Chungcheongnam-do (KR)

(73) Assignee: Samsung Display Co., Ltd. (KR)

( * ) Notice: Subject to any disclaimer, the term of this patent is extended or adjusted under 35 U.S.C. 154(b) by 1332 days.

(21) Appl. No.: 11/932,930

(22) Filed: Oct. 31, 2007

(65) Prior Publication Data

US 2008/0158119 A1 Jul. 3, 2008

(30) Foreign Application Priority Data

Dec. 27, 2006 (KR) ..... 10-2006-0134419

(51) Int. Cl.
*G09G 3/36* (2006.01)

(52) U.S. Cl. ..... 345/90; 345/87; 345/88; 345/89; 345/204; 349/129; 349/130; 349/143

(58) Field of Classification Search ..... 345/87–100, 345/204; 349/129–130
See application file for complete search history.

(56) References Cited

U.S. PATENT DOCUMENTS 6,525,795 B1 * 2/2003 Nishi et al. ..... 349/134
6,894,669 B2 * 5/2005 Suzuki et al. ..... 345/87
7,362,296 B2 * 4/2008 Song et al. ..... 345/89
7,839,369 B2 * 11/2010 Chang et al. ..... 345/89
2002/0044115 A1 * 4/2002 Jinda et al. ..... 345/87
2002/0067332 A1 * 6/2002 Hirakata et al. ..... 345/102
2003/0001845 A1 * 1/2003 Willis ..... 345/443
2003/0169247 A1 * 9/2003 Kawabe et al. ..... 345/204
2003/0227428 A1 * 12/2003 Nose ..... 345/90
2004/0196274 A1 * 10/2004 Song et al. ..... 345/204
2005/0280641 A1 * 12/2005 Kobayashi ..... 345/204
2006/0071927 A1 * 4/2006 Chang et al. ..... 345/211
2006/0145992 A1 * 7/2006 Hsieh et al. ..... 345/94
2006/0176264 A1 * 8/2006 Go ..... 345/100
2007/0057892 A1 * 3/2007 Shin et al. ..... 345/96
2007/0070015 A1 * 3/2007 Chang et al. ..... 345/94
2007/0195047 A1 * 8/2007 Cho ..... 345/98

FOREIGN PATENT DOCUMENTS

CN 1571008 A 1/2005

* cited by examiner

*Primary Examiner* — Grant Sitta
(74) *Attorney, Agent, or Firm* — Innovation Counsel LLP

(57) ABSTRACT

A liquid crystal display (LCD) apparatus includes an LCD section and a driving section. The driving section provides the LCD section with a compensated gradation datum based on a first gradation datum of an (n)-th frame, a second gradation datum of an (n+1)-th frame and a third gradation datum of an (n−1)-th frame. The driving section provides the LCD section with a sum total of a pre-tilt value that is varied in accordance with the gradation and the first gradation datum when the gradation of the second gradation datum is higher than that of the first gradation datum. The driving section provides the LCD section with the first gradation datum when a gradation of the second gradation datum is lower than that of the first gradation datum.

19 Claims, 7 Drawing Sheets

FIG. 3

410

| Gn \ Gn-1 | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 20 | 16 | 8 | 8 | 8 | 7 | 7 | 7 | 6 | 6 | 5 | 5 | 4 | 4 | 3 | 3 | 2 |
| 32 | 46 | 42 | 32 | 16 | 15 | 14 | 11 | 11 | 11 | 9 | 9 | 9 | 7 | 7 | 7 | 7 | 5 |
| 48 | 98 | 79 | 64 | 48 | 32 | 29 | 25 | 22 | 19 | 18 | 17 | 16 | 14 | 14 | 11 | 11 | 7 |
| 64 | 134 | 116 | 96 | 85 | 64 | 50 | 43 | 34 | 28 | 24 | 22 | 21 | 19 | 18 | 17 | 16 | 5 |
| 80 | 155 | 144 | 121 | 107 | 92 | 80 | 71 | 63 | 54 | 46 | 43 | 38 | 36 | 34 | 29 | 24 | 13 |
| 96 | 176 | 159 | 141 | 133 | 115 | 106 | 96 | 86 | 81 | 74 | 69 | 66 | 60 | 55 | 49 | 42 | 32 |
| 112 | 188 | 172 | 157 | 147 | 136 | 129 | 120 | 112 | 104 | 100 | 94 | 90 | 85 | 77 | 71 | 62 | 55 |
| 128 | 196 | 183 | 170 | 163 | 154 | 147 | 141 | 134 | 128 | 118 | 144 | 106 | 101 | 99 | 91 | 84 | 77 |
| 144 | 206 | 194 | 182 | 176 | 171 | 164 | 158 | 153 | 149 | 144 | 134 | 130 | 123 | 117 | 442 | 105 | 99 |
| 160 | 215 | 205 | 200 | 188 | 184 | 181 | 178 | 174 | 170 | 166 | 160 | 156 | 151 | 144 | 139 | 134 | 129 |
| 176 | 223 | 214 | 211 | 199 | 197 | 195 | 192 | 189 | 186 | 183 | 180 | 176 | 170 | 164 | 159 | 154 | 150 |
| 192 | 231 | 224 | 222 | 217 | 215 | 213 | 210 | 208 | 205 | 202 | 199 | 195 | 192 | 188 | 184 | 179 | 174 |
| 208 | 240 | 237 | 234 | 229 | 288 | 226 | 225 | 222 | 219 | 217 | 215 | 214 | 211 | 208 | 203 | 199 | 199 |
| 224 | 246 | 245 | 243 | 238 | 238 | 238 | 238 | 238 | 237 | 235 | 233 | 231 | 229 | 227 | 224 | 222 | 222 |
| 240 | 255 | 255 | 255 | 252 | 250 | 250 | 249 | 248 | 248 | 246 | 245 | 244 | 243 | 242 | 242 | 240 | 240 |
| 256 | 256 | 256 | 256 | 256 | 256 | 256 | 256 | 256 | 256 | 256 | 256 | 256 | 256 | 256 | 256 | 256 | 256 |

FIG. 4

420

| Gn \ Gn+1 | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 6 | 12 | 19 | 26 | 33 | 40 | 47 | 54 | 61 | 68 | 75 | 82 | 88 | 94 | 98 | 100 |
| 16 | 0 | 0 | 6 | 12 | 19 | 26 | 33 | 40 | 47 | 54 | 61 | 68 | 75 | 82 | 88 | 94 | 98 |
| 32 | 0 | 0 | 0 | 6 | 12 | 19 | 26 | 33 | 40 | 47 | 54 | 61 | 68 | 75 | 82 | 88 | 94 |
| 48 | 0 | 0 | 0 | 0 | 6 | 12 | 19 | 26 | 33 | 40 | 47 | 54 | 61 | 68 | 75 | 82 | 88 |
| 64 | 0 | 0 | 0 | 0 | 0 | 6 | 12 | 19 | 26 | 33 | 40 | 47 | 54 | 61 | 68 | 75 | 82 |
| 80 | 0 | 0 | 0 | 0 | 0 | 0 | 6 | 12 | 19 | 26 | 33 | 40 | 47 | 54 | 61 | 68 | 75 |
| 96 | 0 | 0 | 0 | 0 | 0 | 0 | 0 | 6 | 12 | 19 | 26 | 33 | 40 | 47 | 54 | 61 | 68 |
| 112 | 0 | 0 | 0 | 0 | 0 | 0 | 0 | 0 | 6 | 12 | 19 | 26 | 33 | 40 | 47 | 54 | 61 |
| 128 | 0 | 0 | 0 | 0 | 0 | 0 | 0 | 0 | 0 | 6 | 12 | 19 | 26 | 33 | 40 | 47 | 54 |
| 144 | 0 | 0 | 0 | 0 | 0 | 0 | 0 | 0 | 0 | 0 | 6 | 12 | 19 | 26 | 33 | 40 | 47 |
| 160 | 0 | 0 | 0 | 0 | 0 | 0 | 0 | 0 | 0 | 0 | 0 | 6 | 12 | 19 | 26 | 33 | 40 |
| 176 | 0 | 0 | 0 | 0 | 0 | 0 | 0 | 0 | 0 | 0 | 0 | 0 | 6 | 12 | 19 | 26 | 33 |
| 192 | 0 | 0 | 0 | 0 | 0 | 0 | 0 | 0 | 0 | 0 | 0 | 0 | 0 | 6 | 12 | 19 | 26 |
| 208 | 0 | 0 | 0 | 0 | 0 | 0 | 0 | 0 | 0 | 0 | 0 | 0 | 0 | 0 | 6 | 12 | 19 |
| 224 | 0 | 0 | 0 | 0 | 0 | 0 | 0 | 0 | 0 | 0 | 0 | 0 | 0 | 0 | 0 | 6 | 12 |
| 240 | 0 | 0 | 0 | 0 | 0 | 0 | 0 | 0 | 0 | 0 | 0 | 0 | 0 | 0 | 0 | 0 | 6 |
| 256 | 0 | 0 | 0 | 0 | 0 | 0 | 0 | 0 | 0 | 0 | 0 | 0 | 0 | 0 | 0 | 0 | 0 |

LIQUID CRYSTAL DISPLAY APPARATUS AND DRIVING METHOD THEREFOR

CROSS-REFERENCE TO RELATED APPLICATIONS

This application claims priority under 35 U.S.C. §119 to Korean Patent Application No. 2006-134419 filed on Dec. 27, 2006 in the Korean Intellectual Property Office (KIPO), the contents of which are herein incorporated by reference in their entirety.

BACKGROUND OF THE INVENTION

1. Field of the Invention

The present invention relates to a liquid crystal display (LCD) apparatus and, more particularly, to an LCD apparatus capable of optimizing the response speed of the liquid crystal molecules and a driving method for the LCD apparatus.

2. Description of the Related Art

Generally, an LCD apparatus includes a color filter substrate having a common electrode, an array substrate having a pixel electrode and liquid crystal disposed between the color filter substrate and the array substrate. When an electric field is applied between the common electrode and the pixel electrode, the arrangement of liquid crystal molecules interposed between the common electrode and the pixel electrode is changed. When the arrangement of the liquid crystal molecule is changed, the transmittance of light is changed in accordance with the arrangement of the liquid crystal molecule, so that an image may be displayed. s tend to exhibit moving pictures poorly because the response speed of the liquid crystal is slower than the period one of a motion picture frame, causing a moving image to become blurred. Therefore, it would be desirable to optimize the response speed of the liquid crystal to improve the display quality of moving pictures.

To optimize the response speed of a liquid crystal of the LCD device, a controller of the display device may operate in an overdrive mode in which over-compensated or under-compensated (higher or lower) drive current is provided to speed up the time to reach a desired brightness. To perform the overdrive mode, a dynamic capacitance compensation (referred to as DCC) may be used.

When the DCC is used, an overdriving value of a gradation datum may be determined based on comparison between the gradation datum corresponding to the preceding frame and a gradation datum corresponding to a current frame.

When using an overdrive circuit, a look-up table (LUT) that stores measured overdrive values is typically used since the overdrive value determined according to the comparison between current and previous gradation data does not change linearly with gray level owing to liquid crystal properties. In general, measurement of a compensation value (or overdrive value) stored in the LUT is carried out under the conditions that the vertical frequency is 60 Hz and the temperature is normal temperature.

A pre-tilting method may be used to optimize the response speed of the liquid crystal molecules. In the pre-tilting method, when images are quickly changed from a black gradation of a low voltage into a white gradation of a high voltage, the pre-tilt forming signal for pre-tilting the liquid crystal molecules is output, and then a high gradation signal that is higher than a target pixel voltage is output during a following frame interval.

In the pre-tilting method, an LUT is used, which has a plurality of pre-tilting values mapped therein corresponding to a current frame gradation datum and a following frame gradation datum. However, the LUT has a plurality of fixed pre-tilting values, so that the response speed of liquid crystal molecules between detail gradations is not optimized.

SUMMARY OF THE INVENTION

According to an aspect of the present invention, a liquid crystal display (LCD) apparatus having better response speed includes an LCD section and a driving section. The driving section provides the LCD section with a compensated gradation datum on the basis of a first gradation datum of an (n)-th frame and a second gradation datum of an (n+1)-th frame, where, 'n' denotes a natural number greater than two. The driving section provides the LCD section with a sum of a pre-tilt value that is varied in accordance with the first gradation datum and the second gradation datum.

In an exemplary embodiment, the driving section may further include a second memory that stores a plurality of pre-tilt values of a look-up table (LUT) type in correspondence with the first gradation datum and the third gradation datum.

In an exemplary embodiment, the driving section may provide the LCD section with a compensated gradation datum based on the first gradation datum, the second gradation datum and a third gradation datum of an (n−1)-th frame. The driving section may include a first memory that stores a plurality of overdriving gradation data of an LUT type in correspondence with the first gradation datum and the third gradation datum.

In an exemplary embodiment, the driving section may determine the overdriving quantity of the (n)-th frame based on a first gradation datum of the (n)-th frame and a third gradation datum of the (n−1)-th frame.

In an exemplary embodiment, the driving section may include a timing control section, a data driver and a gate driver. The timing control section receives a gradation datum from an image signal source, and compares a first gradation datum of the (n)-th frame with a second gradation datum of the (n+1)-th frame to generate a compensated gradation datum of the (n)-th frame that is reflected in a varying pre-tilt value. The data driver converts the compensated gradation datum into a data voltage to provide the LCD section with an image signal. The gate driver sequentially provides the LCD section with scan signals In an exemplary embodiment, the timing control section may include the first memory, the second memory and a compensation part. The compensation part receives the second gradation datum of the (n+1)-th frame, extracts a pre-tilt value stored in the second memory, and reflects the pre-tilt value to the first gradation datum to provide the data driver with a compensated gradation datum of the (n)-th frame.

In an exemplary embodiment, the compensation part may output a compensation gradation date for an overdriving waveform that is higher than the target voltage of the (n)-th frame when the first gradation datum of the (n)-th frame and the second gradation datum of the (n+1)-th frame are different from each other. The compensated gradation datum is a signal for forming an overshooting waveform when a gradation of the first gradation datum is smaller than that of the second gradation datum. The compensated gradation datum is a signal for forming an undershoot waveform when a gradation of the first gradation datum is greater than that of the second gradation datum.

In an exemplary embodiment, the driving section may determine a pre-tilt quantity of the (n)-th frame based on a first gradation datum of the (n)-th frame and a second gradation datum of the (n+1)-th frame, wherein the determined pre-tilt quantity is reflected in the compensated gradation datum.

In an exemplary embodiment, the driving section may determine an overdriving quantity of the (n)-th frame based on a first gradation datum of the (n)-th frame and a third gradation datum of the (n−1)-th frame. Here, the determined overdriving quantity may be reflected in the compensated gradation datum.

In an exemplary embodiment, the amplitude of the pre-tilt value may be increased as the difference between the gradation of the first gradation datum and that of the second gradation datum is increased.

In an exemplary embodiment, the compensated gradation datum may be delayed by one frame interval and then output to the LCD section.

In an exemplary embodiment, a full-gradation number of the images may be 256, and the maximum value of the pre-tilt value may be a gradation datum corresponding to a 100th-gradation.

In an exemplary embodiment, the minimum value of the pre-tilt value may be a gradation datum that corresponds to a 6th-gradation.

In an exemplary embodiment, the driving section may provide the LCD section with the sum of the pre-tilt value and the first gradation datum when the gradation of the second gradation datum is higher than that of the first gradation datum. The driving section may provide the LCD section with the first gradation datum when the gradation of the second gradation datum is lower or substantially equal to that of the first gradation datum.

In another aspect of the present invention, an LCD apparatus includes a plurality of gate lines, a plurality of data lines electrically insulated from the gate lines and being extended along a different direction from that of the gate lines to define a plurality of pixel areas arranged in a matrix shape, and a plurality of pixels formed in the pixel areas. According to the method of driving the LCD apparatus, scan signals are sequentially provided to the gate lines. A gradation datum is received from an image signal source, and then a first gradation datum of the (n)-th frame is compared with the second gradation datum of the (n+1)-th frame to generate a compensated gradation datum of the (n)-th frame having a varied pre-tilt value reflected therein. Here, 'n' denotes a natural number greater than two. Then, a data voltage that corresponds to the compensated gradation datum is provided to the data line.

In an exemplary embodiment, in receiving a gradation datum, the varied pre-tilt value is added to the first gradation datum to generate the compensated gradation datum when the gradation of the second gradation datum is higher than that of the first gradation datum. Moreover, the first gradation datum is generated as the compensated gradation datum when the gradation of the second gradation datum is lower than that of the first gradation datum.

In an exemplary embodiment, a full-gradation number of the images is 256, and the maximum value of the pre-tilt value is a gradation datum that corresponds to the 100th-gradation. The minimum value of the pre-tilt value is a gradation datum that corresponds to the 6th-gradation.

According to the LCD apparatus and the method for driving the LCD apparatus, the compensated gradation datum h as a variable pre-tilt value determined in accordance with the variation of the gradation, to optimize the response speed of the liquid crystal molecules between detail gradations.

BRIEF DESCRIPTION OF THE DRAWINGS

The above and other advantages of the present invention will become readily apparent by reference to the following detailed description when considered in conjunction with the accompanying drawings wherein:

FIG. 3 is a table showing an example of a first look-up table (LUT) that is stored in the first memory of FIG. 2;

FIG. 4 is a table showing an example of a second LUT that is stored in the second memory of FIG. 2;

DESCRIPTION OF THE EMBODIMENTS

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present.

Hereinafter, the present invention will be described in detail with reference to the accompanying drawings.

Figure 1:
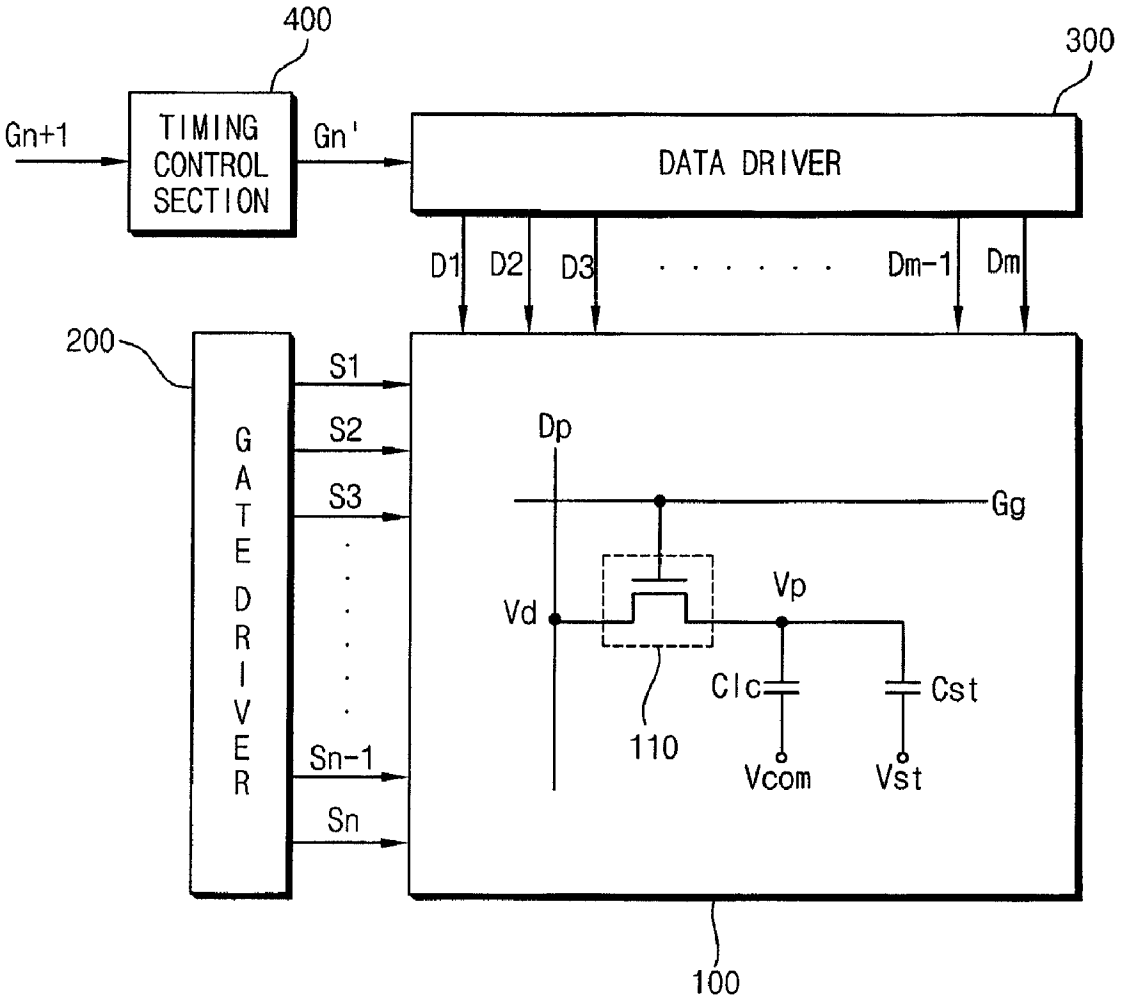
FIG. 1 is a block diagram showing a liquid crystal display (LCD) apparatus according to an exemplary embodiment of the present invention.

FIG. 1 is a block diagram showing a liquid crystal display (LCD) apparatus according to an exemplary embodiment of the present invention.

Referring to FIG. 1, an LCD apparatus according to the present invention includes an LCD panel 100, a gate driver 200, a data driver 300 and a timing control section 400. The gate and data drivers 200 and 300, and the timing control section 400 operate as a driving device that converts a signal provided from an external host system such as a graphic controller to a signal that is adequate to the LCD panel 100.

The LCD panel 100 includes a plurality of gate lines (or scan lines) for transferring a gate-on signal and a plurality of data lines (or source lines) for transferring a compensated gradation data signal. Each of the data lines and each of the gate lines define a pixel. The pixel includes a thin-film transistor (TFT) 110, a liquid crystal capacitor Clc and a storage capacitor Cst. The TFT 110 includes a gate electrode that is electrically connected to one of the gate lines, and a source electrode that is electrically connected to one of the data lines.

When a gate ON signal is supplied to the gate line Sn to turn on the TFT 10, the data voltage Vd supplied to the data line DL is supplied to each pixel electrode (not shown) via the TFT 10. An electric field corresponding to a difference between the pixel voltage Vp supplied to the pixel electrode and the common voltage Vcom is supplied to the liquid crystal (shown as the liquid crystal capacitor in FIG. 1) so that the light permeates the TFT 110 corresponding to the strength of the electric field. The pixel voltage Vp is maintained during one frame period. In FIG. 1, a storage capacitor Cst may be used in an auxiliary manner so as to maintain the pixel voltage Vp supplied to the pixel electrode.

The liquid crystal molecules have anisotropic permittivity, meaning that the permittivity depends on the directions of the liquid crystal molecules. When the direction of the liquid crystal molecules is changed by the voltage supplied to the liquid crystal, its permittivity is also changed, and accordingly, the capacitance of the liquid crystal capacitor (hereinafter, referred to as the liquid crystal capacitance) is also changed. The liquid crystal capacitor is charged while the TFT 110 is turned-on, after which the TFT 110 is turned-off. When the liquid crystal capacitance is changed, the pixel voltage Vp at the liquid crystal molecules is also changed, since Q=CV.

The liquid crystal layer of the LCD panel 100 includes a twist nematic (TN) mode, an in plane switching (IPS) mode, a vertical alignment (VA) mode, etc. The liquid crystal layer of the VA mode has rapid response speed, and has been widely used. In order to increase the viewing angle of the LCD panel having the VA mode, a patterned vertical alignment (PVA) mode, a multi-domain vertical alignment (MVA) mode, etc., have been devised. The VA mode is a liquid crystal mode in which the rubbing direction of the array substrate is substantially parallel to that of the color filter substrate and the rubbing directions of the array substrate and color filter substrate are opposite to each other. The MVA mode is a liquid crystal mode in which the rubbing direction of the array substrate crosses the rubbing direction of the color filter substrate with an angle of about 0 degree to about 90 degree and the rubbing directions of the array substrate and color filter substrate are opposite to each other.

The gate driver 200 sequentially applies gate on voltages S1, S2, S3, . . . , Sn to the gate lines, thereby turning-on the TFT 110 electrically connected to the gate line.

The data driver 300 receives the compensated gradation data Gn' from the timing controlling section 400, converts the compensated gradation datum Gn' into a plurality of data signals D1, D2, . . . , Dm of gradation voltages (data voltages), and applies the data signals D1, D2, . . . , Dm to each data line.

The timing controlling section 400 receives a gradation datum Gn+1 of a following frame (i.e., the (n+1)-th frame) from a gradation data source, for example, a graphic controller (not shown), and outputs a compensated gradation datum Gn' of the current frame on the basis of the current frame (i.e., the (n)-th frame) gradation datum Gn, a previous frame (i.e., the (n−1)-th frame) gradation datum Gn−1, and a following frame (i.e., the (n+1)-th frame) gradation datum Gn+1, were, 'n' denotes a natural number greater than two.

When the (n)-th frame gradation datum Gn is equal to the (n+1)-th frame gradation datum Gn+1, the timing controlling section 400 does not compensate the (n)-th frame gradation datum Gn and provides the data driver 300 with the (n)-th frame gradation datum Gn.

However, when the (n)-th frame gradation datum Gn corresponds to a black gradation and the (n+1)-th frame gradation datum Gn+1 corresponds to a bright gradation or a white gradation, the timing controlling section 400 provides the data driver 300 with a compensated gradation datum to form a higher gradation than the black gradation in correspondence with the (n)-th frame.

The timing controlling section 400 provides the data driver 300 with the compensated gradation datum Gn' for overdriving the liquid crystal molecules in correspondence with the (n)-th frame by comparing the (n)-th frame gradation datum Gn with the (n−1)-th frame gradation datum Gn−1.

The timing controlling section 400 provides the data driver 300 with the compensated gradation datum Gn' for pre-tilting liquid crystal molecules in correspondence with the (n)-th frame by comparing the (n)-th frame gradation datum Gn with the (n+1)-th gradation datum Gn+1.

Although FIG. 1 shows the timing controlling section 400 is a stand-alone unit, it may be integrated in a graphic card, an LCD module, a timing controller or a data driver.

According to the above, the data voltage is compensated and the compensated data voltage is applied to the pixel, so that the pixel voltage achieves the target voltage level. Therefore, though the structure of the LCD panel is not changed and the liquid crystal molecules are not changed, the response speed of the liquid crystal molecules is optimized so that a moving picture, etc may be clearly displayed.

Figure 2:
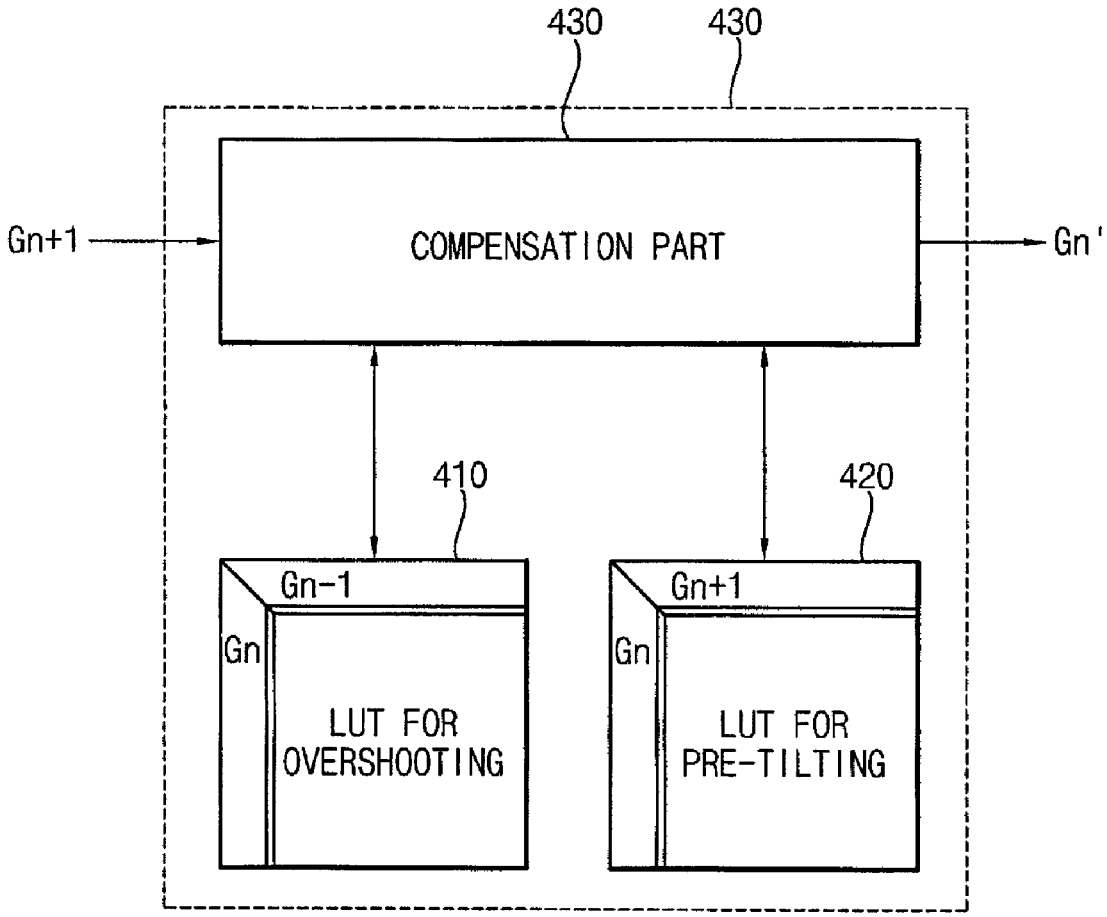
FIG. 2 is a block diagram showing a timing control section according to an exemplary embodiment of the present invention.

FIG. 2 is a block diagram showing a timing control section according to an exemplary embodiment of the present invention.

Referring to FIGS. 1 and 2, timing control section 400 according to an exemplary embodiment of the present invention includes a first memory 410, a second memory 420 and a compensation part 430.

The first memory 410 stores gradation data having an overdriving value reflected therein, which corresponds to an (n)-th frame gradation datum Gn and an (n+1)-th frame gradation datum Gn+1. The overdriving value includes an overshooting value that is greater than the target pixel voltage and an undershooting value that is smaller than the target value. In FIG. 2, the first memory 410 stores an LUT for overshooting.

The second memory 420 stores a pre-tilt value according to the (n)-th frame gradation datum Gn and the (n+1)-th frame gradation datum Gn+1. In FIG. 2, the second memory 420 stores an LUT for pre-tilting.

The compensation part 430 provides a compensated gradation datum for forming a different target voltage of the (n)-th frame to the data driver 300 when the target voltage of the (n−1)-th frame is different from the (n)-th frame gradation datum Gn. The compensated gradation datum that is provided to the data driver 300 is delayed about one frame.

For example, when a gradation datum Gn−1 corresponding to the (n−1)-th frame is smaller than that of a gradation datum Gn corresponding to the (n)-th frame, the compensation part 430 provides the data driver 300 with a compensated gradation datum for forming an overshooting waveform that is greater than a target voltage of the (n)-th frame.

When a gradation datum Gn−1 corresponding to the (n−1)-th frame is greater than that of the gradation datum Gn corresponding to the (n)-th frame, the compensation part 430 provides the data driver 300 with a compensated gradation datum for forming an undershoot waveform that is lower than the target voltage of the (n)-th frame.

When a datum Gn−1 corresponding to the (n−1)-th frame is equal to that of the gradation datum Gn corresponding to the (n)-th frame, the compensation part 430 provides the data driver 300 with the gradation datum corresponding to the target voltage of the (n)-th frame.

The compensation part 430 receives the (n+1)-th frame gradation datum Gn+1, extracts a pre-tilt value stored in the second memory 420, and provides the data driver 300 with the compensated gradation datum Gn' of the (n)-th frame by reflecting the pre-tilt value to the gradation datum corresponding to the (n)-th frame.

For example, when the gradation datum Gn corresponding to the (n)-th frame is greater than or equal to that of the gradation datum Gn+1 corresponding to the (n+1)-th frame, and an undershoot with pre-tilt assistance is deemed to not be needed, the compensation part 430 provides the data driver 300 with the gradation datum corresponding to the target voltage of the (n)-th frame.

When a gradation datum Gn corresponding to the (n)-th frame is lower than that of the gradation datum Gn+1 corresponding to the (n+1)-th frame, the compensation part 430 adds the pre-tilt value that varies according to the gradation to the target voltage of the (n)-th frame, and provides the data driver 300 with the gradation datum corresponding to the added voltage.

FIG. 3 is a table showing an example of a first look-up table (LUT) that is stored in the first memory of FIG. 2. Particularly, FIG. 3 shows an example of a gradation datum having overdriving values reflected therein.

Referring to FIG. 3, when the (n−1)-th frame gradation datum Gn−1 is a relatively high gradation and the (n)-th frame gradation datum Gn is a relatively low gradation, gradation datum for forming an undershooting waveform are stored in the first LUT 410.

When the (n−1)-th frame gradation datum Gn−1 is a relatively low gradation and the (n)-th frame gradation datum Gn is a relatively high gradation, gradation datum for forming an overshooting waveform are stored in the first LUT 410.

For example, when the (n−1)-th frame gradation datum Gn−1 is an 80th-gradation and the (n)-th frame gradation datum Gn is a 32nd-gradation, the overdriving value may be a gradation datum corresponding to the 14th-gradation. The gradation datum corresponding to 14th-gradation may be a gradation datum having an undershooting value reflected thereto.

When the (n−1)-th frame gradation datum Gn−1 is an 80th-gradation and the (n)-th frame gradation datum Gn is a 208th-gradation, the overdriving value may be a gradation datum corresponding to the 226th-gradation. The gradation datum corresponding to the 226th-gradation may be a gradation datum having an overshooting value reflected therein.

FIG. 4 is a table showing an example of a second LUT that is stored in the second memory of FIG. 2. Particularly, FIG. 4 shows an example of the second LUT that is stored in the second memory.

Referring to FIG. 4, when the (n)-th frame gradation datum Gn is a relatively high gradation and the (n+1)-th frame gradation datum Gn+1 is a relatively low gradation, a pre-tilt value of zero level is stored in the second LUT 420.

When the (n)-th frame gradation datum Gn is a relatively low gradation and the (n+1)-th frame gradation datum Gn+1 is a relatively high gradation, a plurality of pre-tilt values that vary in accordance with a gradation is stored in the second LUT 420.

For example, when the (n)-th frame gradation datum Gn is a 32nd-gradation and the (n+1)-th frame gradation datum Gn+1 is a 80th-gradation, respectively, the pre-tilt value may be a gradation datum corresponding to the 19th-gradation.

When the (n)-th frame gradation datum Gn and the (n+1)-th frame gradation datum Gn+1 are a 208th-gradation and an 80th-gradation, respectively, the pre-tilt value may have a zero level. The pre-tilt value of a zero level is stored because the loss of response speed of the liquid crystal molecules does not occur even thought the direction of the liquid crystal molecules is not changed when images are changed from high gradation to low gradation.

Figure 5:
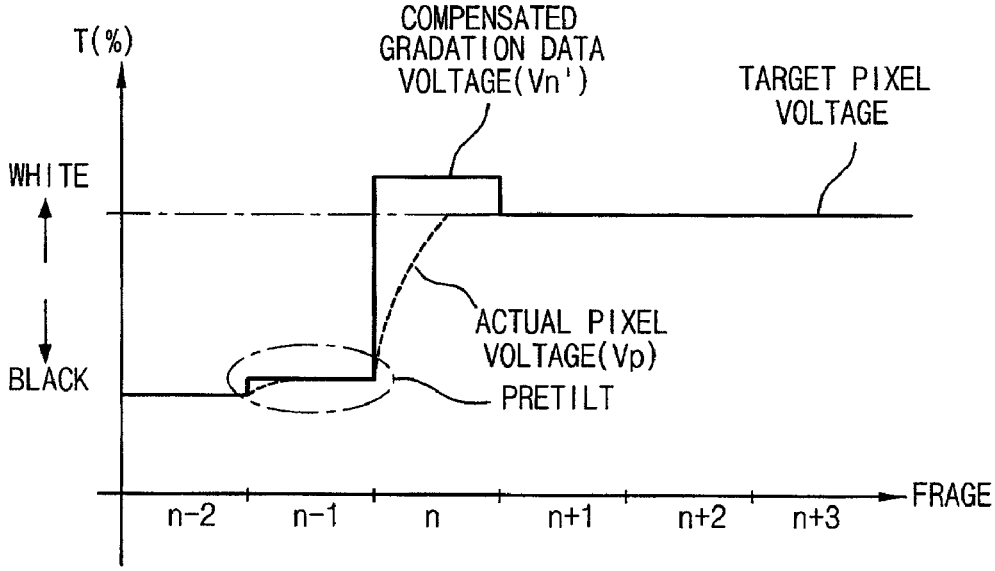
FIG. 5 is a graph showing a method of applying voltage according to an exemplary embodiment of the present invention.

As described above, in order to optimize a response speed of liquid crystal molecules, when a gradation datum is changed from a black gradation to a white gradation in the (n)-th frame, a pre-tilt voltage, for example, about 2 V to about 3.5 V is applied to a pixel electrode so as to pre-tilt the liquid crystal molecule in the (n−1)-th frame, in accordance with following FIG. 5. Therefore, when a gradation datum is changed to a white gradation in the (n)-th frame, the response speed of liquid crystal molecules may be optimized.

FIG. 5 is a graph showing a method of applying voltage according to an exemplary embodiment of the present invention.

Referring to FIG. 5, according to an exemplary embodiment of the present invention, in a consideration of an (n)-th frame target pixel voltage, an (n−1)-th frame pixel voltage (or a data voltage) and an (n+1)-th frame pixel voltage, a compensated gradation data voltage Vn' is applied to an LCD panel, so that an (n)-th frame actual pixel voltage Vp may quickly approach the target pixel voltage.

That is, when images are changed from a black gradation to a white gradation, a relatively higher voltage than the voltage corresponding to the black gradation is applied to the LCD panel before one frame of the white gradation, so that the liquid crystal molecules is pre-tilted. Considering that the black voltage is about 0.5 V to about 1.5 V, the high voltage for pre-tilting the liquid crystal molecules may be about 2 V to about 3.5 V.

When the full-gradation number is 256, the 0th-gradation to 50th-gradation may be defined as the black gradation and 200th-gradation to 255th-gradation may be defined as the white gradation. A range of the black or white gradation may be set by the designer of the LCD device. Alternatively, the voltage for pre-tilting the liquid crystal molecules may be set to have different values in correspondence with each gradation.

When the images are changed to a white gradation at the next following frame, the response speed of the liquid crystal molecules may be optimized from a black gradation to a white gradation.

Particularly, when the (n)-th frame is black gradation, it may be known what kind of a gradation signal of the (n+1)-th frame would follow. When the gradation signal of the (n+1)-th frame is white gradation or bright gradation, a gradation signal that is greater than a black gradation is applied to the data driver during the (n)-th frame.

Accordingly, a compensated gradation datum for pre-tilting and a compensated gradation datum for overdriving is output so that the response speed of the liquid crystal molecules may be optimized when the gradation datum is changed from a black gradation to a white gradation.

Figure 6:
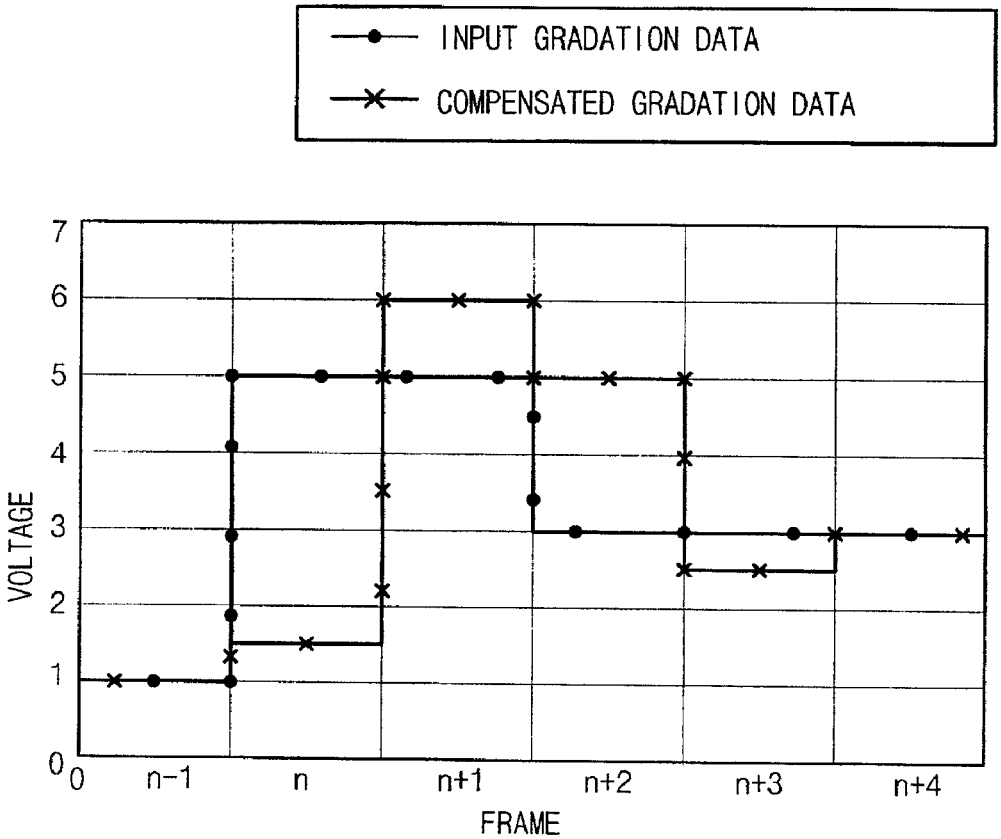
FIG. 6 is waveforms showing an outputted compensated gradation datum with respect to an inputted gradation datum according to an exemplary embodiment of the present invention.

FIG. 6 is waveforms showing the output compensated gradation datum with respect to an input gradation datum according to an exemplary embodiment of the present invention.

Referring to FIG. 6, when an input gradation data signal is about 1 V during the (n−1)-th frame, about 5 V during the (n)-th frame and the (n+1)-th frame and 3 V during and after the (n+2)-th frame, the compensated gradation datum according to an exemplary embodiment of the present invention is output as following.

In response, the compensated gradation data signal of 1.5 V corresponding to the input gradation data signal for the (n−1)-th frame is applied for the (n)-th frame to pre-tilt the liquid crystal molecule. Then, the compensated gradation data signal of 6 V corresponding to the input gradation data signal for the (n)-th frame is applied for the (n+1)-th frame and the compensated gradation data signal of 5 V corresponding to the input gradation data signal for the (n+1)-th frame is applied for the (n+2)-th frame. The compensated gradation data signal of 2.5 V corresponding to the input gradation data signal for the (n+2)-th frame is applied for the (n+3)-th frame and the compensated gradation data signal of 3 V corresponding to the input gradation data signal for the (n+3)-th frame is applied for the (n+4)-th frame and the frame thereafter.

Therefore, the compensated gradation datum according to an exemplary embodiment of the present invention is delayed one frame with respect to a gradation datum input from an external device such as a graphic controller. When the image quickly changes from the black gradation of the low voltage to the white gradation of the high voltage, a signal for pre-tilting a liquid crystal molecule is output at (n)-th frame, and then a relatively higher gradation signal than the target pixel voltage is output at the (n+1)-th frame, so that the response speed of the liquid crystal molecules may be optimized.

As described above, when a gradation datum is transient from a low gradation such as a black gradation to a high gradation such as a white gradation, the pre-tilt values that varies in accordance with gradation is applied to the data driver corresponding to the low gradation, so that the response speed of the liquid crystal molecules may be optimized. The pre-tilt value is represented as a gradation value that corresponds to a voltage level. For example, when the pre-tilt value is about 80, the pre-tilt value is a voltage value corresponding to 80th-gradation.

When a full-gradation number of the image is 256, the maximum value of the pre-tilt value corresponds to the 100th-gradation and the minimum value of the pre-tilt value corresponds to the 6th-gradation.

When the maximum value of the pre-tilt value is more than about 100, a distortion is generated in the voltage waveform and the square wave of the voltage waveform is slanted. Therefore, the response speed of the liquid crystal molecules may not be optimized.

Figure 7A:
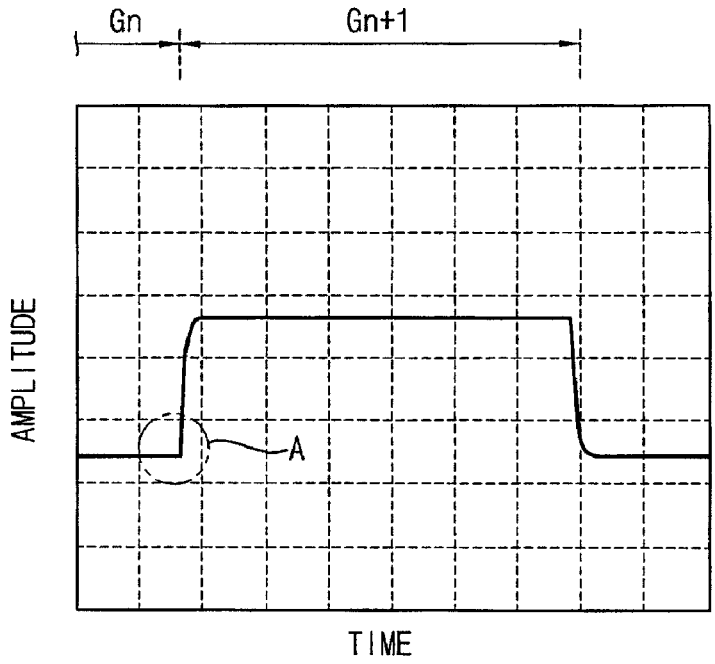
FIGS. 7A and 7C are graphs showing a distortion of a waveform when a pre-tilt value is varied.
Figure 7B:
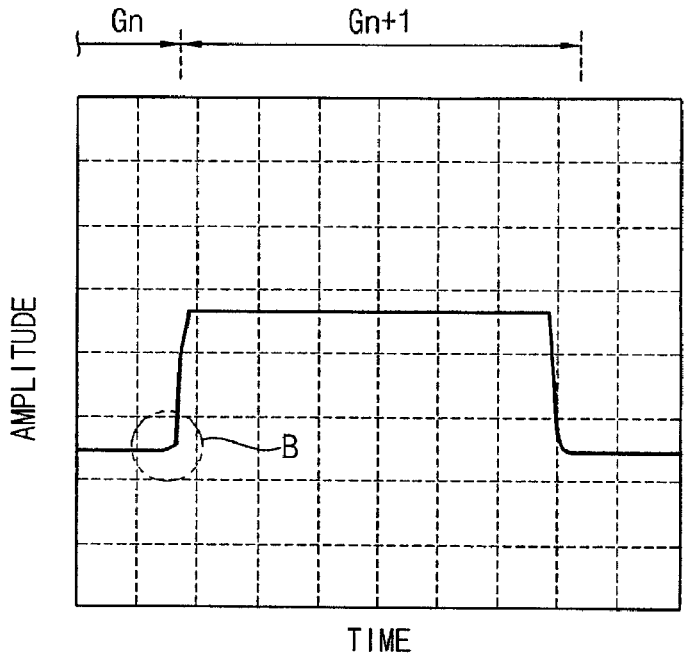
Figure 7C:
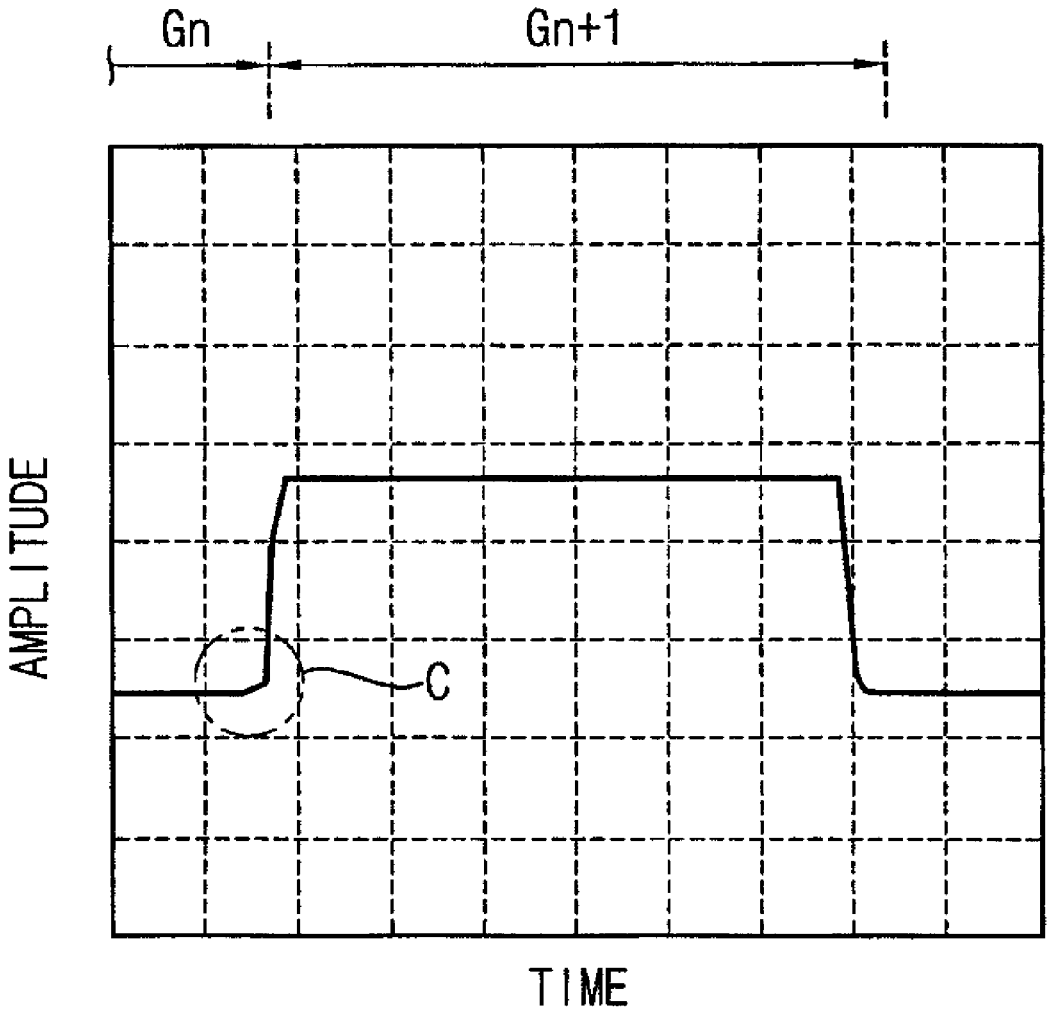

FIGS. 7A and 7C are graphs showing distortion of the waveform when a pre-tilt value is varied.

Referring to FIG. 7A, when the (n)-th frame gradation datum Gn is a relatively low gradation, the (n+1)-th frame gradation datum Gn+1 is a relatively high gradation, and the pre-tilt value corresponds to about 80 (i.e., a voltage value corresponding to 80th-gradation), a distortion is not generated in the square waveform.

That is, when the (n)-th frame gradation datum Gn corresponding to a relatively low gradation is transient to the (n+1)-th frame gradation datum Gn+1 corresponding to a relatively high gradation, a voltage value corresponding to 80th-gradation datum as the pre-tilt value is applied to the data driver. A waveform distortion is not generated in a portion 'A' where a gradation datum corresponding to a relatively low gradation is transient to a gradation datum corresponding to a relatively high gradation. Therefore, the response speed of the liquid crystal molecules may be optimized.

Referring to FIG. 7B, when the (n)-th frame gradation datum Gn is a relatively low gradation, the (n+1)-th frame gradation datum Gn+1 is a relatively high gradation, and the pre-tilt value corresponds to about 120 (i.e., a voltage value corresponding to 120th-gradation), a distortion is generated in the square waveform.

That is, when the (n)-th frame gradation datum Gn corresponding to a relatively low gradation is transient to the (n+1)-th frame gradation datum Gn+1 corresponding to a relatively high gradation, a voltage value corresponding to an 120th-gradation datum as the pre-tilt value is applied to the data driver. A waveform distortion is generated in a portion 'B' where a gradation datum corresponding to a relatively low gradation is transient to a gradation datum corresponding to a relatively high gradation. Therefore, the response speed of the liquid crystal molecules may not be optimized by the waveform distortion generated in the portion 'B'.

Referring to FIG. 7C, when the (n)-th frame gradation datum Gn is a relatively low gradation, the (n+1)-th frame gradation datum Gn+1 is a relatively high gradation, and the pre-tilt value corresponds to about 150 (i.e., a voltage value corresponding to 150th-gradation), a serious distortion is generated in the square waveform.

That is, when the (n)-th frame gradation datum Gn corresponding to a relatively low gradation is transient to the (n+1)-th frame gradation datum Gn+1 corresponding to a relatively high gradation, a voltage value corresponding to an 150th-gradation datum as the pre-tilt value is applied to the data driver. Here, a waveform distortion is greatly generated in a portion 'C' where a gradation datum corresponding to a relatively low gradation is transient to a gradation datum corresponding to a relatively high gradation. That is, the waveform distortion with a slope of about 45 degrees is generated in the portion 'C'. Therefore, the response speed of the liquid crystal molecules may not be optimized by the waveform distortion generated in the portion 'C'.

As described above, according to the present invention, the pre-tilt value that varies in accordance to a gradation variation is applied to the LCD panel, the response speed of liquid crystal molecules may be optimized not only for transient images from a full-low gradation (i.e., a black gradation) into a full-high gradation (i.e., a white gradation), but also for overall variation of gradation.

Although the exemplary embodiments of the present invention have been described, it is understood that the present invention should not be limited to these exemplary embodiments but various changes and modifications can be made by one ordinary skilled in the art in light of and within the spirit and scope of the present teachings.

What is claimed is:

1. A liquid crystal display (LCD) apparatus comprising:

an LCD section displaying images by using liquid crystal molecules; and a driving section providing a compensated gradation datum of an (n)-th frame to the LCD section based on a first gradation datum of the (n)-th frame and a second gradation datum of an (n+1)-th frame when a gradation of the second gradation datum is higher than a gradation of the first gradation datum, wherein 'n' denotes a natural number greater than two, and the driving section providing the first gradation datum without compensation to the LCD section when the gradation of the second gradation datum is lower or substantially equal to the gradation of the first gradation datum, wherein the compensated datum is generated by adding a pre-tilt value to the first gradation datum, the pre-tilt value is varied in accordance with the first gradation datum and the second gradation datum, and a level of the pre-tilt value is increased as a difference between the gradation of the second gradation datum and that of the first gradation datum is increased.

2. The LCD apparatus of claim 1, wherein the driving section further comprises a second memory that stores a plurality of pre-tilt values of an LUT type in correspondence with the first gradation datum and the second gradation datum.

3. The LCD apparatus of claim 2, wherein the driving section comprises:

a timing control section receiving a gradation datum from an image signal source, and comparing a first gradation datum of the (n)-th frame with a second gradation datum of the (n+1)-th frame to generate a compensated gradation datum of the (n)-th frame that is reflected in a varying pre-tilt value;

a data driver converting the compensated gradation datum into a data voltage to provide the LCD section with an image signal; and a gate driver sequentially providing the LCD section with scan signals.

4. The LCD apparatus of claim 3, wherein the timing control section comprises:

a compensation part receiving the second gradation datum of the (n+1)-th frame, extracting a pre-tilt value stored in the second memory, and reflecting the pre-tilt value to the first gradation datum to provide the data driver with a compensated gradation datum of the (n)-th frame.

5. The LCD apparatus of claim 4, wherein the compensation part outputs the compensated gradation datum for an overdriving waveform that is higher than the target voltage of the (n)-th frame when the first gradation datum of the (n)-th frame and the second gradation datum of the (n+1)-th frame are different from each other.

6. The LCD apparatus of claim 5, wherein the compensated gradation datum is a signal for forming an overshooting waveform when a gradation of the first gradation datum is smaller than that of the second gradation datum.

7. The LCD apparatus of claim 5, wherein the compensated gradation datum is a signal for forming an undershoot waveform when a gradation of the first gradation datum is greater than that of the second gradation datum.

8. The LCD apparatus of claim 2, wherein the driving section providing the LCD section with a compensated gradation datum based on the first gradation datum and a third gradation datum of an (n−1)-th frame, the driving section further comprises a first memory that stores a plurality of overdriving gradation data of a look-up table (LUT) type in correspondence with the first gradation datum and the third gradation datum.

9. The LCD apparatus of claim 8, wherein the driving section determines the overdriving quantity of the (n)-th frame based on a first gradation datum of the (n)-th frame and a third gradation datum of the (n−1)-th frame.

10. The LCD apparatus of claim 2, wherein the driving section determines a pre-tilt quantity of the (n)-th frame based on a first gradation datum of the (n)-th frame and a second gradation datum of the (n+1)-th frame, wherein the determined pre-tilt quantity is reflected in the compensated gradation datum.

11. The LCD apparatus of claim 10, wherein the driving section determines an overdriving quantity of the (n)-th frame based on a first gradation datum of the (n)-th frame and a third gradation datum of the (n−1)-th frame, wherein the determined overdriving quantity is reflected in the compensated gradation datum.

12. The LCD apparatus of claim 1, wherein the compensated gradation datum is delayed by one frame interval and then output to the LCD section.

13. The LCD apparatus of claim 1, wherein a full-gradation number of the images is 256, and the maximum value of the pre-tilt value is a gradation datum corresponding to a 100th-gradation.

14. The LCD apparatus of claim 13, wherein the minimum value of the pre-tilt value is a gradation datum that corresponds to a 6th-gradation.

15. The LCD apparatus of claim 1, wherein the driving section provides the LCD section with the sum of the pre-tilt value and the first gradation datum when the gradation of the second gradation datum is higher than that of the first gradation datum, and provides the LCD section with the first gradation datum when the gradation of the second gradation datum is lower or substantially equal to that of the first gradation datum.

16. A method for driving a liquid crystal display apparatus including a plurality of gate lines, a plurality of data lines electrically insulated from the gate lines and which extend along a different direction from that of the gate lines to define a plurality of pixel areas arranged in a matrix shape, and a plurality of pixels being formed in the pixel areas, the method comprising:

providing the gate lines with scan signals, sequentially;

comparing a first gradation datum of an (n)-th frame received from an image signal source with a second gradation datum of an (n+1)-th frame received from the image signal source to generate a compensated gradation datum of the (n)-th frame by adding a variable pre-tilt value to the first gradation datum when a gradation of the second gradation datum is higher than a gradation of the first gradation datum (wherein 'n' denotes a natural number greater than two); and providing the data lines with a data voltage that corresponds to the compensated gradation datum, wherein the pre-tilt value is not added to the first gradation datum when the gradation of the second gradation datum is lower or substantially equal to the gradation of the first gradation datum, the pre-tilt value is varied in accordance with the first gradation datum and the second gradation datum, and a level of the pre-tilt value is increased as a difference between the gradation of the second gradation datum and that of the first gradation datum is increased.

17. The method of claim 16, wherein generating the compensated gradation datum comprises:

adding the varied pre-tilt value to the first gradation datum to generate the compensated gradation datum when a gradation of the second gradation datum is higher than that of the first gradation datum; and generating the first gradation datum as the compensated gradation datum when a gradation of the second gradation datum is lower than that of the first gradation datum.

18. The method of claim 16, wherein a full-gradation number of the images is 256, and the maximum value of the pre-tilt value is a gradation datum corresponding to a 100th-gradation.

19. The method of claim 18, wherein the minimum value of the pre-tilt value is a gradation datum that corresponds to a 6th-gradation.

* * * * *